United States Patent [19]

Huykman

[11] Patent Number: 5,066,538

[45] Date of Patent: Nov. 19, 1991

[54] NONWOVEN INSULATING WEBS

[75] Inventor: William Huykman, Saint Louisville, Ohio

[73] Assignee: Ultrafibre, Inc., Granville, Ohio

[21] Appl. No.: 499,041

[22] Filed: Mar. 26, 1990

Related U.S. Application Data

[60] Division of Ser. No. 224,444, Jul. 25, 1988, Pat. No. 4,933,129.

[51] Int. Cl.[5] ..... B32B 7/00; D02G 3/00

[52] U.S. Cl. ..... 428/288; 428/361; 428/375; 428/379; 428/389; 428/285; 428/286; 428/289

[58] Field of Search ..... 428/361, 375, 379, 389, 428/288

[56] References Cited

U.S. PATENT DOCUMENTS

| | | | |
|---|---|---|---|
| 2,699,415 | 1/1955 | Nachtman | 428/389 X |
| 2,720,076 | 10/1955 | Sachara | 428/361 X |
| 2,731,046 | 1/1956 | Bachner | 428/389 X |
| 2,797,469 | 7/1957 | Kahn | 428/361 X |
| 2,862,783 | 12/1958 | Drummond | 428/389 X |
| 4,042,737 | 8/1977 | Forsgren et al. | 428/389 X |
| 4,312,913 | 1/1982 | Rheaume | 428/263 X |

*Primary Examiner*—Lorraine T. Kendell

*Attorney, Agent, or Firm*—Marshall & Melhorn

[57] ABSTRACT

High performance, metallic coated staple fibers and nonwoven insulating webs made up of such fibers are produced. The process includes providing a nonwoven substantially two-dimensional web of fibers wherein at least a portion of 50 percent of the fibers are exposed to one or the other side of the web. This web is metallized with a low emissivity metal(s) and/or alloy(s) to produce a coated web wherein at least 50 percent of the surface area of the web fibers are coated with metal and or alloy. The coated web is shredded into individual, staple fibers which are thereafter united to produce a nonwoven, lofty three-dimensional insulating web having a density of between about 0.02 to 2 pounds per cubic foot.

4 Claims, No Drawings

NONWOVEN INSULATING WEBS

This is a division of application Ser. No. 07/224,444, filed July 25, 1988, now U.S. Pat. No. 4,933,129.

BACKGROUND OF THE INVENTION

1. Field of the Invention

The invention relates to a process for producing high performance fibers and nonwoven insulating webs including such fibers, which webs are particularly suited for use as garment or sleeping bag interlinings. More specifically, the invention concerns an insulating web which includes a mass of metal coated glass or synthetic polymer fibers, and to a process for producing same.

2. Description of the Prior Art

The commonly practived technology for producing insulation webs is to fashion webs composed of a mass of fine fibers. The fibers stop any gaseous convection and somewhat block radiation heat transfer by causing a multitude of fiber to fiber radiation exchanges. In each exchange, some radiant energy is blocked from moving through the pack. If one wants to further reduce the radiation heat transfer, more fibers are added.

Many nonwoven materials have been suggested and used for insulating interliners. J. L. Cooper and M. J. Frankosky, "Thermal Performance of Sleeping Bags" Journal of Coated Fabrics, Volume 10, pages 108–114 (October 1980 compares the insulating value of various types of fibrous materials that have been used as interliners in sleeping bags and other articles. Among the products compared are polyester fiberfill of solid or hollow or other special fibers and a product of 3M Company (St. Paul, Minn.) called Thinsulate ®. Generally, polyester fiberfill is made from crimped polyester staple fiber and is used in the form of quilted batts. Usually, batt bulk and bulk durability are maximized in order to increase the amount of thermal insulation. Hollow polyester fibers have found widespread use in such fiberfill batts because of the increased bulk they offer, as compared to solid fibers. In certain fiberfill materials such as Hollowfil ®II, a product of E. I. du Pont de Nemours and Company (Wilmington, Del.), the polyester fibers are coated with a wash-resistant silicone slickener to provide additional bulk stability and fluffability. For fiber processability and in-use bulk, slickened and non-slickened fiberfill fibers for use in garments have usually been in the range of 5 to 6 denier (22 to 25 microns diameter). A special fiberfill, made from a blend of slickened and non-slickened 1.5 denier polyester staple fibers and crimped polyester staple fiber having a melting point below that of the other polyester fibers, in the form of a needle-punched, heat-bonded batt, is reported to exhibit excellent thermal insulation and tactile aesthetic properties. Such fiberfill batts are also discussed in U.S. Pat. No. 4,304,817. "Thinsulate" is an insulating material in the form of a thin, relatively dense, batt of polyolefin microfibers, or of the microfibers in mixture with high denier polyester fibers. The high denier polyester fibers are present in the "Thinsulate" bats to increase the low bulk and bulk recovery provided to the batt by the microfibers alone. For use in winter sports outerwear garments, these various insulating materials are often combined with a layer of film of porous poly (-tetrafluoroethylene) polymer of the type disclosed in U.S. Pat. No. 4,187,390.

Although the above-described prior art nonwovens have been useful as insulating interliners, various improvements would significantly enhance their utility. For example, it has been known for many years that if the optical properties of the fibers are changed, the radiation heat transfer can be changed. The reference "Thermal Insulation: What It Is and How It Works" by Charl M. Pelanne in the Journal of Thermal Insulation, Vol. 1 (April 1978) teaches that radiation can be controlled by the emittances of the surfaces involved or by the insertion of absorbing or reflecting surfaces (sheet, fibers, particles, etc.) between the two temperature boundaries. The article "Analytical Models For Thermal Radiation In Fibrous Insulations" by T. W. Tong and C. L. Tien in the Journal of Thermal Insulation, Vol. 4 (July 1980) attempts to quantify the effect by creating models for heat transfer in fibrous insulations.

Now, even though it has been known for many years that modifying the optical properties of the fibers can be beneficial, the difficulty has been in establishing a commercially acceptable process of modification. These properties can be modified some by changing the composition of the fibers but not to the extent necessary to obtain the lowest heat transfer.

What is desired is a fiber that neither absorbs nor radiates radiant energy. This would be a fiber with an emissivity of 0 and an absorbtivity of 0. Some materials are known to have very low emissivities and absorbtivities such as gold (0.02), silver (0.02), and aluminum (0.04). Fibers made of these materials could be produced but they would be expensive, heavy, exhibit plastic deformation instead of elastic deformation, and exhibit other limiting properties.

What would be clearly desirable is to coat fibers made out of the desired fiber material with a material which would modify the surface of the fiber to yield a low emissivity/absorbtivity.

Since most of the fibers of interest, such as polymers and glass, are nonconductive, electroplating is not possible. Electroless plating is possible but many of the materials that can produce a low emissivity can not be used as coating materials by this method. Aluminum is an example.

One method which would be highly desirable would be to vacuum metallize the fibers. Unfortunately, this method can only coat in a straight line of a sight. Fibrous insulating webs are comprised of so many fibers that a straight line of sight coating would coat less the 7 percent of the fibers in a typical web that is 0.5 inch thick and 0.5 pounds per cubic foot density.

The process taught by Foragres, Melamed, and Welner in U.S. Pat. No. 4,042,737 is well suited for wet processing where continuous metal plated filament or yarn is required, but has major deficiencies where metal coated staple fiber is desired. The knitting process is very slow (approximately 100 grams of 40 microns continuous nylon fiber per hour) and becomes much slower and more difficult when the fiber denier is in the desired range for thermal insulation (less than about 25 microns). If a continuous yarn is used instead of a filament in order to increase through-put, the internal filaments of the yarn would not be metal coated in a vacuum metallization process.

Thus the problem: for years scientists have known that a low emissivity coating on fibers used in insulation webs would be desirable. However, there has been no practical method for producing the coated fibers for use in the webs.

SUMMARY OF THE INVENTION

The present invention answers the need for a process to produce metal coated staple fiber. The process is applicable for fine denier fibers, e.g., less than about 40 microns, at a production through-put of greater than 100 pounds per hour which is practical for production of insulating fiber.

More particularly, the process includes first providing a substantially two-dimensional nonwoven web of staple or continuous filament fibers composed either of glass, synthetic polymers or mixtures thereof. As used herein and in the appended claims, the term "two-dimensional" defines a thickness wherein at least a portion of 50 percent of the fibers is exposed to one or the other side of the web. The two-dimensional web, for example in roll form, is then vacuum metallized with a low emissivity (e.g., less than 0.1) material such as a metal or metal alloy of aluminum, gold, silver, or mixtures thereof to produce a coated web wherein at least a total of 50 percent of the surface area of the web fibers are coated with the metal or metal alloy. After metallization, the coated web is shredded into individual, staple fibers and these staple fibers thereafter united to produce a nonwoven, lofty three-dimensional insulating web having a density of between 0.02 to 2 pounds per cubic foot.

OBJECTS AND ADVANTAGES

It is, therefore, an object of this invention to provide an insulating fiberfill having increased warmth with less weight or less bulk, and improved durability, fabric drape (flexibility) and ease of cutting and sewing when compared with present day commercially available materials.

Another object of the invention is the provision of a fiber having a greatly improved ability to retard radiation heat transfer thereby dramatically improving the performance of any fibrous insulation into which it is blended.

A still further object of the invention is to provide a novel method of producing a lofty insulating web, which method is efficient and cost effective.

Yet another object of the invention is the production of a specialty high performance fiber for use in insulation webs for garments and sleeping bags.

Finally, it is an object of the invention to produce a metal coated fine diameter polymer fiber which is the most thermally effective fiber commercially available.

Other objects and advantages of the invention will become more apparent during the course of the following detailed description.

DESCRIPTION OF THE PREFERRED EMBODIMENTS

For use in accordance with the invention, a two-dimensional nonwoven web of fibers composed either of glass, synthetic polymers or mixtures thereof is provided. The fibers of the web should have a diameter no greater than 50 microns and preferably be in the range of 1 to 40 microns. Fibers of synthetic polymers are most desirable, among which may be mentioned polyesters, nylons, acrylics and polyolefins such as polypropylene. Polyester fibers of a diameter in the range of 7 to 23 microns are particularly preferred. The fibers may be crimped or uncrimped or mixtures thereof, staple or continous filament.

It is essential that at least a portion of 50 percent of the fibers is exposed to one or the other side of the nonwoven web. Thus, webs having thicknesses greater than that which would provide this exposure are not suitable since the required amount of fiber surface area would not be plated or coated in the subsequent step of the method of the invention. Preferably, at least a total of 50 percent of the surface area of the fibers in the web is exposed to one or the other side of the web. Nonwoven webs of this structure are available commercially, for example Reemay® spunbonded polyester, sold by Reemay, Inc., Old Hickory, Tenn., having an area weight of 0.1 to 5 ounces per square yard and preferably in the range of 0.25 to 1.0 ounce per square yard. Another nonwoven web which may be used is formed from carded 1.5 denier polyester crimped staple fiber with an area weight of approximately 15 grams per square yard bonded with approximately 10 percent by weight binder. The fibers in this web are primarily orientated along the machine direction.

The two-dimensional nonwoven web, preferably in roll form, is next, in accordance with the invention, vacuum metallized. Such coating or plating process is well known in the art, particularly in connection with the continuous vacuum metallizing of synthetic polymer films, e.g., polyester films, and will not be discussed in detail here. Suffice to say, the process covers the surface of the continuous substrate film or web with a metallic layer by evaporating the metal and recondensing it on the substrate. The process is carried out in a chamber from which the air is evacuated until the residual pressure is approximately one-millionth of normal atmospheric pressure. The clean substrate is mounted within the vacuum chamber in such a way that it is exposed by line of sight to the metal vapor.

The metal vapor is produced by heating the metal to be evaporated to such a temperature that its vapor pressure appreciably exceeds the residual pressures within the chamber. Thus, the metal is converted to a vapor and is transferred in this form to the relatively cool substrate.

The thickness of deposited metal is determined by power input to the heaters, pressure in the vacuum chamber, and web speed. In practice, adjustment of web speed is the more usual method of varying the thickness of the deposited metal. Variations in this thickness across the web can be corrected by adjustment of the power input to the individual heaters. Thickness of the deposit can be monitored by using photoelectric devices or by measuring electrical resistivity.

As a general rule, metallized coatings in accordance with the invention are on the order of 100 to 1000 angstroms thick, have an emissivity of not appreciably greater than 0.04, and consist of aluminum, gold, silver or alloys thereof in which the stated metals comprise at least 50 weight percent. Mixtures of the metals and/or alloys thereof may also be employed. As a compromise between low emissivity and cost, aluminum is the preferred coating metal.

It is essential to the invention that at least 50 percent of the total surface area of the web fibers is coated with metal during the metallization process. In this connection, it has been found that the area weight of the two-dimensional web should be in the range of 10 to 25 grams per square yard after coating with aluminum, for example, to produce a satisfactory web for further processing in accordance with the invention. Particularly excellent results are obtained with a coated web having an area weight of 12 to 17 grams per square yard.

As previously mentioned, the process of the present invention includes, subsequent to metallizing the two-dimensional web, shredding the web into individual staple coated fibers. Any commercially avialable equipment effective to separate and open fibers can be employed. For example, good results have been obtained when using a J. D. Hollingsworth On Wheels, Inc. "Shreadmaster".

The fibers resulting from the shredding operation can best be characterized as at least 90 percent open, individual, metallized, staple fibers.

The individual coated staple fibers are next processed to produce a lofty three-dimensional web. Generally, any commercially available procedure for forming a nonwoven web or batt can be employed, among which may be mentioned carding, garnetting, and Rando-Webber techniques. The resulting finished lofty web should have a density of between about 0.02 to 2.0 pounds per cubic foot and, preferably, between about 0.2 to 0.8 pounds per cubic foot.

The finished web in accordance with the invention may comprise 100 percent of coated fiber or may be a blend of the metallized fiber and unmetallized fibers. If a blend, at least 75 percent of the thermal conductivity of the finished web can be obtained from just the metallized fiber. The inclusion of the uncoated fibers is sometimes helpful to impart to the finished web improved hand (feel), drape, wash durability or loft. The blending operation can be carried out after shredding and before the carding or like operation.

In addition, binder fibers, i.e., fibers that melt or partially melt when the lofty web passes through an oven after carding or the like, may be blended with the metallized fibers to improve the lofty web integrity. The binder fibers may be single component, in which case the entire fiber melts, or bicomponent, in which case only an outside sheath of the fiber melts. These latter fibers may be of the type available from Hoechst Celanese Corporation under the designation Celbond TM, or from DuPont Company by calling for DuPont DACRON polyester binder fibers. It should be appreciated, however, that use of any fiber blends must still result in a web having a density in the 0.02 to 2.0 pounds per cubic foot range.

Rather than binder fibers, binder chemicals can be used in the finished web of the invention to improve lofty web integrity. In this instance, the chemicals can be sprayed unto the lofty web after carding and the chemicals thereafter cured when the web is passed through a curing oven just prior to cutoff and roll-up of the finished web for storage or shipping. An example of a suitable binder can be obtained under the designation Rhoplex® TR-407 from Rohn and Haas Company, Philadelphia, PA. "Rhoplex TR-407" is an acrylic emulsion which when applied to fiberfill achieves maximum durability to both washing and drycleaning by curing, for example, for 1 to 2 minutes at 300° F. after drying.

The metallized fiber in accordance with the invention may also have applied thereto any of the commercially available fiber finishes. An example of one such material is Dow Corning® 108 water-based emulsion, a 35 percent aminofunctional silicone polymer that can be air dried and air cured.

EXAMPLE I

This example illustrates a preferred method by which a high performance staple fiber and a nonwoven fibrous web, both in accordance with the invention, are produced that are suitable for use in or, as the case may be, as an insulating interliner.

A two-dimensional carded nonwoven web of staple polyester fibers was provided. This web was formed from carded 1.5 denier polyester crimped staple fiber with an area weight of approximately 15 grams per square yard bonded with approximately 10 percent by weight acrylic binder. The fibers in this web are primarily orientated along the machine direction.

The web was vacuum metallized with aluminum metal to provide a coated web wherein approximately 75 percent of the surface area of the web fibers had about a 500 angstroms thick aluminum coating thereon and resulted in a coated web of 16 grams per square yard area weight.

The coated web was next shredded into predominantly individual coated staple fibers using a J. D. Hollingsworth On Wheels, Inc. "Shreadmaster".

The individual staple fibers were then carded into a lofty three-dimensional web having a density of 0.3 pound per cubic foot.

The following table illustrates the greatly improved thermal properties obtained with the resultant web of the invention. These webs were tested in an Anacon Model 88 thermal tester using ASTM C-518 test procedure.

TABLE 1

| Material | Conductivity (k) (BTU-in/hr-sq.ft- °F.) | R/Inch | Clo/Inch |
|---|---|---|---|
| Example I | 0.34 | 2.94 | 3.34 |
| Control* | 0.40 | 2.50 | 2.84 |
| Hollowfil ® II (5.5 dpf polyester; 0.3 pounds per cubic foot density) | 0.54 | 1.85 | 2.10 |

*Web as produced in Example I, but with metallization step omitted.

Based on the thermal testing of these materials at various density levels, the density of each material required to obtain a specific conductivity of 0.34 (k) was as follows:

| Material | Density (pounds per cubic foot) | Percentage Advantage |
|---|---|---|
| Example I | 0.30 | 0 |
| Control* | 0.42 | 40 |
| Hollowfil ® II | 1.00 | 333 |

EXAMPLE II

Example I was repeated except that the individul staple fibers were carded into a lofty three-dimensional web having a density of 0.5 pound per cubic foot.

The following table illustrates the improved thermal properties of the resultant web in accordance with the invention.

TABLE 2

| Material | Conductivity (k) (BTU-in/hr-sq.ft- °F.) | R/Inch | Clo/Inch |
|---|---|---|---|
| Example I | 0.29 | 3.45 | 3.92 |
| Control* | 0.31 | 3.23 | 3.67 |
| Hollowfil ® II | 0.40 | 2.50 | 2.84 |

TABLE 2-continued

| Material | Conductivity (k) (BTU-in/hr-sq.ft- °F.) | R/Inch | Clo/Inch |
|---|---|---|---|
| (5.5 dpf polyester; 0.3 pounds per cubic foot density) | | | |

It will be understood from this disclosure and from the appended claims that the present invention is not limited to the particular materials nor to the particular embodiment now preferred and described herein to illustrate the invention. Accordingly, the present invention embraces equal embodiments which will become apparent to those skilled in the art from this disclosure and which are embraced by the following claims.

What is claimed is:

1. High performance fibers produced by forming a substantially two-dimensional non-woven web of fibers composed of glass, synthetic polymers or mixtures thereof, said web having a thickness such that at least 50 percent of the fibers is exposed to one or the other side of the web; vacuum metallizing the web with a metal, metal alloy, or mixtures thereof having an emissivity less than 0.1 to produce a web wherein at least 50 percent of the surface area of the web fibers is coated with a metallic material; and shredding the metallized web into individual, coated staple fibers.

2. High performance fibers for use in insulating webs for garments, sleeping bags and the like, produced by: forming a substantially two dimensional non-woven web of fibers composed of glass, synthetic polymers or mixtures thereof, said web having a thickness such that at least 50 percent of the surface area of the fibers is exposed to one or the other side of the web; vacuum metallizing the web with a low emissivity metal selected from the group consisting of aluminum, gold, silver and mixtures thereof to produce a web wherein at least 50 percent of the surface area of the web fibers is coated with metal; and shredding the metallized web into individual, coated staple fibers.

3. A lofty insulating web produced by: providing a substantially two-dimensional non-woven web of fibers composed of glass, synthetic polymers or mixtures thereof, said web having a thickness such that at least 50 percent of the fibers is exposed to one or the other side of the web; vacuum metallizing the web with a metal, metal alloy, or mixtures thereof having an emissivity less than 0.1 to produce a web wherein at least 50 percent of the surface area of the web fibers is coated with a metal or metal alloy; shredding the metallized web into individual, coated staple fibers; and uniting the coated stable fibers to form a lofty three-dimensional web or batt having a density of between about 0.02 to 2 pounds per cubic foot.

4. A lofty insulating web produced by: providing a substantially two-dimensional non-woven web of fibers composed of glass, synthetic polymers or mixtures thereof, said web having a thickness such that at least 50 percent of the surface area of the fibers is exposed to one or the other side of the web; vacuum metallizing the web with a low emissivity metal selected from the group consisting of aluminum, gold, silver or mixtures thereof to produce a web wherein at least 50 percent of the surface area of the web fibers is coated with metal; shredding the metallized web into individual, coated staple fibers; and uniting the coated stable fibers to form a lofty three dimensional web or batt having a density of between about 0.02 to 2 pounds per cubic foot.

* * * * *